US007210251B1

(12) United States Patent
Rolle

(10) Patent No.: US 7,210,251 B1
(45) Date of Patent: May 1, 2007

(54) SHOE WITH INTERCHANGEABLE COVERS

(76) Inventor: Gwendolyn M. W. Rolle, P.O. Box F43695, Freeport, FL (US) 43695

( * ) Notice: Subject to any disclaimer, the term of this patent is extended or adjusted under 35 U.S.C. 154(b) by 0 days.

(21) Appl. No.: 10/428,428

(22) Filed: May 3, 2003

(51) Int. Cl.
*A43B 3/24* (2006.01)

(52) U.S. Cl. ..... 36/100; 36/15; 36/101

(58) Field of Classification Search ..... 36/15, 36/100, 101, 42, 11.5, 7.1 R, 7.7
See application file for complete search history.

(56) References Cited

U.S. PATENT DOCUMENTS

| | | | | | |
|---|---|---|---|---|---|
| 2,526,940 | A | * | 10/1950 | Fello | 36/11.5 |
| 4,300,294 | A | * | 11/1981 | Riecken | 36/97 |
| 4,314,412 | A | * | 2/1982 | Anderson et al. | 36/100 |
| 4,333,247 | A | * | 6/1982 | Marinelli | 36/11.5 |
| 5,454,382 | A | * | 10/1995 | Tariah et al. | 128/882 |
| 5,822,888 | A | * | 10/1998 | Terry | 36/100 |
| 5,992,058 | A | * | 11/1999 | Jneid | 36/100 |

* cited by examiner

*Primary Examiner*—M. D. Patterson

(57) ABSTRACT

The shoe with interchangeable covers is a modified pair of women's shoes consisting of a base, a sole with a removable heel, and a cover which is attached to the base and the sole with two sets of straps joining under the sole and fastened together with hook and loop type fasteners. The base of the shoe features a layer of padding for extra comfort and low rising vertical sides for supporting the interchangeable cover. The sole of the shoe is formed with a pair of notches on the bottom, one in the toe area and one in the arch area. These notches serve as guides into which the straps are placed and secured to one another. The cover can be made in various styles from dressy and elegant to casual and sporty by adding decorative items, such as zippers, buttons, bows, and the like and by varying the heel height and width. The interchangeable covers and heels allow the owner to have numerous pairs of shoes for the price of one. Thus any woman could save money through the purchase of one pair of shoes as opposed to purchasing shoes to coordinate with every outfit in her wardrobe. Additionally, the female traveler could pack a single pair of shoes to complete a number of ensembles, thereby reducing the load with which she travels.

18 Claims, 4 Drawing Sheets

SHOE WITH INTERCHANGEABLE COVERS

BACKGROUND OF THE INVENTION

1. Field of the Invention

The present invention relates to footwear, more particularly to a woman's shoe with interchangeable covers. The shoe with interchangeable covers has particular utility in connection with providing an easy and affordable way to accessorize a single pair of women's shoes to match multiple outfits.

2. Description of the Prior Art

Fashion dictates that a woman's outfit coordinates with her handbag and shoes. Owning a sufficient number of shoes to complete a matching ensemble for each outfit in her wardrobe is extremely costly for most women. Additionally, since shoe fashions rapidly change, there is an ever present need to update the shoe wardrobe to complement the clothing wardrobe. Shoes with interchangeable covers are desirable for allowing a single pair of shoes to be modified with various styles and colors so that they match multiple outfits. This would save the owner a tremendous a mount of money over the years, especially if new covers matching the latest fashions were manufactured to fit the same base pair of shoes.

In addition to being costly, an updated shoe wardrobe can be hard to transport if one is traveling on business or vacation. In order to dress fashionably, women tend to travel with a different pair of shoes for each outfit that has been packed. Not only could shoes with interchangeable covers save the owner vast amounts of money, but they could also eliminate the need to pack and transport multiple pairs of shoes during travel.

The use of shoe covers is known in the prior art. For example, U.S. Pat. No. 5,778,564 to Mark Kettner discloses an athletic or sport shoe having a removable cover for the upper that is removably secured to the unfinished shoe upper by hook and loop fastener strips on the lower parts of the cover and shoe upper adjacent to the line where the upper joins the sole of the shoe. However, since the Kettner '564 patent focuses on athletic shoes, it does not make any provision for covering the heel of a woman's high-heeled shoe. Additionally, the Kettner '564 patent would not be suitable for most women's dress shoes since it provides for a tongue and eyelets found in lace-up style shoes. Furthermore, since the Kettner '564 patent proposes covering the original shoe upper with a second layer, the user's feet would heat up quickly and possibly be uncomfortable while pursuing athletic endeavors. Finally, the cover of the Kettner '564 patent is only secured around the edges of the shoe; in athletic endeavors, this could easily be knocked loose, and the cover would disengage from the upper of the shoe.

U.S. Pat. No. 4,850,122 to Robert L. Schwab, Jr. discloses a shoe cover, probably made of a stretch fabric, comprising a pouch with two lobes, one for covering the outside of the shoe and one for covering the inside of the shoe. The pouch is closed with the exception of an opening at the area of the heel of the shoe into which the toe of the shoe is inserted for proper fitment of the cover. However, the cover of the Schwab, Jr. '122 patent would not effectively cover the heel portion of a ladies high-heeled shoe, leaving it a different color than the remainder of the shoe. An additional deficiency is that the Schwab, Jr. '122 patent proposes using a stretchable material to implement the shoe cover. Stretchable material would not make a suitable cover because it would tear more easily and be less durable than typical shoe covering material. Furthermore, should dress material be used to make matching shoe covers, it could be difficult, if not impossible, to clean if spotted or soiled. Lastly, since the Schwab, Jr. '122 patent discloses a shoe cover to be placed over an existing shoe, the wearer's foot could become overheated from the dual covering.

Similarly, U.S. Pat. No. 3,270,442 to Jack S. Liebmann and Ralph Memole discloses a decorative cover for women's high-heeled pumps comprising a shoe upper member secured to a soft leather sole, the whole of which is secured to the shoe along the inner edges adjacent to the foot. A hollow cup with an opening at the bottom would be fitted over the heel for matching purposes. However, the Liebmann, et al. '442 patent is designed to fit only pumps having an eggshell throat and a long, slender heel. These types of pumps are not always fashionable, thus the Liebmann, et al. '442 device would not always be useful. Additionally, depending on the type of adhesive used to secure the Liebmann, et al. '442 device, the original shoe material could be ruined. Finally, the Liebmann, et al. '442 patent proposes a cover to fit over an existing shoe, which could cause a higher degree of heat for the wearer's feet.

Likewise, U.S. Pat. No. 2,013,700 to Rosilda C. Savale discloses a dress shoe cover that consists of an upper open at the top and bottom, an elastic member about the open bottom of the upper and so formed as to fit a shoe above the sole, and means of passing the elastic member between the sole and shrank of the shoe for securement. However, the Savale '700 patent does not cover the heel of the shoe, leaving it a different color than the remainder of the shoe. Furthermore, the securement of the shoe cover in the Savale '700 patent is not sufficient, making it possible that the cover might slide at the toe or heel section and reveal the old shoe beneath. If the Savale '700 device is constructed from dress type material, it would not be durable, leaving it vulnerable to wear and tear due to everyday wear and the elements. Finally, the Savale '700 patent discloses a covering for a shoe, which would place two layers on the wearer's feet and could cause discomfort from a buildup of heat.

Lastly, U.S. Pat. No. Des. 322,152 to Stephen G. Irons discloses the ornamental design for a shoe protector that is placed on the front of the shoe and covers the toe and tongue area of the shoe. However, the Irons '152 patent protects only the front portion of the shoe, causing an uneven wear pattern between the front and rear portions of the shoe. Additionally, the Irons '152 device would not be useful for accessorizing an outfit, changing only the color of the front portion of the shoe while leaving the rear portion the original color. Finally, it is not obvious how the Irons '152 device would be secured to the shoe, but the securement means indicated seems insufficient since the shoe protector could slip off the shoe during the course of normal usage.

While the above-described devices fulfill their respective, particular objectives and requirements, the aforementioned patents do not describe a shoe with interchangeable covers that allows the wearer to easily and comfortably update a single pair of shoes to coordinate with multiple outfits. The Kettner '564 device would not be suitable for most women's dress shoes since it provides for a tongue and eyelets found in lace-up style shoes, and the Irons '152 patent would not be useful for accessorizing an outfit, changing only the color of the front portion of the shoe while leaving the rear portion the original color. Moreover, the covers proposed by the Kettner '564, Schwab, Jr. '122, Savale '700, and Irons '152 patents do not sufficiently cover the heel of the shoe, leaving it a different color than the remainder of the shoe. While the Liebmann, et al. '442 device does cover the heel of the shoe, it is designed to fit only pumps having an eggshell throat and a long, slender heel. These types of pumps are not always fashionable, thus the Liebmann, et al. '442 device would not always be useful. The Kettner '564, Liebmann, et al. '442, Savale '700, and Irons '152 patents all have securement deficiencies. The Kettner '564, Savale '700, and Irons '152 devices could all come loose from the shoe they are covering during the course of normal usage, and the type of adhesive used to secure the Liebmann, et al. '442 device might ruin the original shoe material. Furthermore, the Schwab, Jr. '122 and Savale '700 patents propose using fabric type material for shoe covers, which would be less durable than typical shoe covering material, tearing more easily, wearing more quickly, and posing cleaning difficulties. Finally, the Kettner '564, Schwab, Jr. '122, Liebmann, et al. '442, and Savale '700 patents all propose a cover to fit over an existing shoe, which could cause foot discomfort from a buildup of heat.

Therefore, a need exists for a new and improved shoe with interchangeable covers that can be used for easily and comfortably updating a single pair of shoes to coordinate with multiple outfits. In this regard, the present invention substantially fulfills this need. In this respect, the shoe with interchangeable covers according to the present invention substantially departs from the conventional concepts and designs of the prior art, and in doing so provides an apparatus primarily developed for the purpose of allowing the wearer to easily and comfortably update a single pair of shoes to coordinate with a variety of outfits, eliminating the need to transport multiple pairs of shoes while traveling.

SUMMARY OF THE INVENTION

In view of the foregoing disadvantages inherent in the known types of shoe covers now present in the prior art, the present invention provides an improved shoe with interchangeable covers, and overcomes the above-mentioned disadvantages and drawbacks of the prior art. As such, the general purpose of the present invention, which will be described subsequently in greater detail, is to provide a new and improved shoe with interchangeable covers which has all the advantages of the prior art mentioned heretofore and many novel features that result in a shoe with interchangeable covers which is not anticipated, rendered obvious, suggested, or even implied by the prior art, either alone or in any combination thereof.

To attain this, the present invention essentially comprises a modified pair of women's shoes consisting of a base, a sole with a removable heel, and a cover which is attached to the base and the sole with two sets of straps joining under the sole and fastened together with hook and loop type fasteners.

There has thus been outlined, rather broadly, the more important features of the invention in order that the detailed description thereof that follows may be better understood and in order that the present contribution to the art may be better appreciated.

The invention may also include a layer of padding added to the base for additional comfort. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved shoe with interchangeable covers that has all of the advantages of the prior art shoe covers and none of the disadvantages.

It is another object of the present invention to provide a new and improved shoe with interchangeable covers that may be easily and efficiently manufactured and marketed.

An even further object of the present invention is to provide a new and improved shoe with interchangeable covers that has a low cost of manufacture with regard to both materials and labor, and which accordingly is then susceptible of low prices of sale to the consuming public, thereby making such a shoe with interchangeable covers economically available to the buying public.

Still another object of the present invention is to provide a new shoe with interchangeable covers that provides in the apparatuses and methods of the prior art some of the advantages thereof, while simultaneously overcoming some of the disadvantages normally associated therewith.

Even still another object of the present invention is to provide a shoe with interchangeable covers for allowing the wearer to easily and quickly change the outer appearance of the shoe cover. This allows the wearer to have one pair of shoes that matches a multitude of outfits, saving the wearer the expense and hassle of buying and traveling with numerous pairs of shoes.

Yet another object of the present invention is to provide a shoe with interchangeable covers that provides a single layer of covering for the foot. This allows the wearer to change the shoe cover without adding an additional layer of shoe material to the foot, thereby avoiding a buildup of heat in the foot area and avoiding foot discomfort.

Still yet another object of the present invention is to provide a padded shoe with interchangeable covers. This provides additional comfort to the wearer, especially if the shoes are worn for an extended period of time.

Even yet another object of the present invention is to provide a shoe with interchangeable covers that has a removable heel. This not only allows the wearer to modify the style of the shoe by varying the height and width of the heel, but also extends the life of the shoe by ensuring that the heel of the shoe can be replaced when it is worn.

Lastly, it is an object of the present invention to provide a new and improved shoe with interchangeable covers that provides numerous styles of covers for the shoe. This allows the wearer to create any fashion style from dressy and elegant to sporty and casual.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
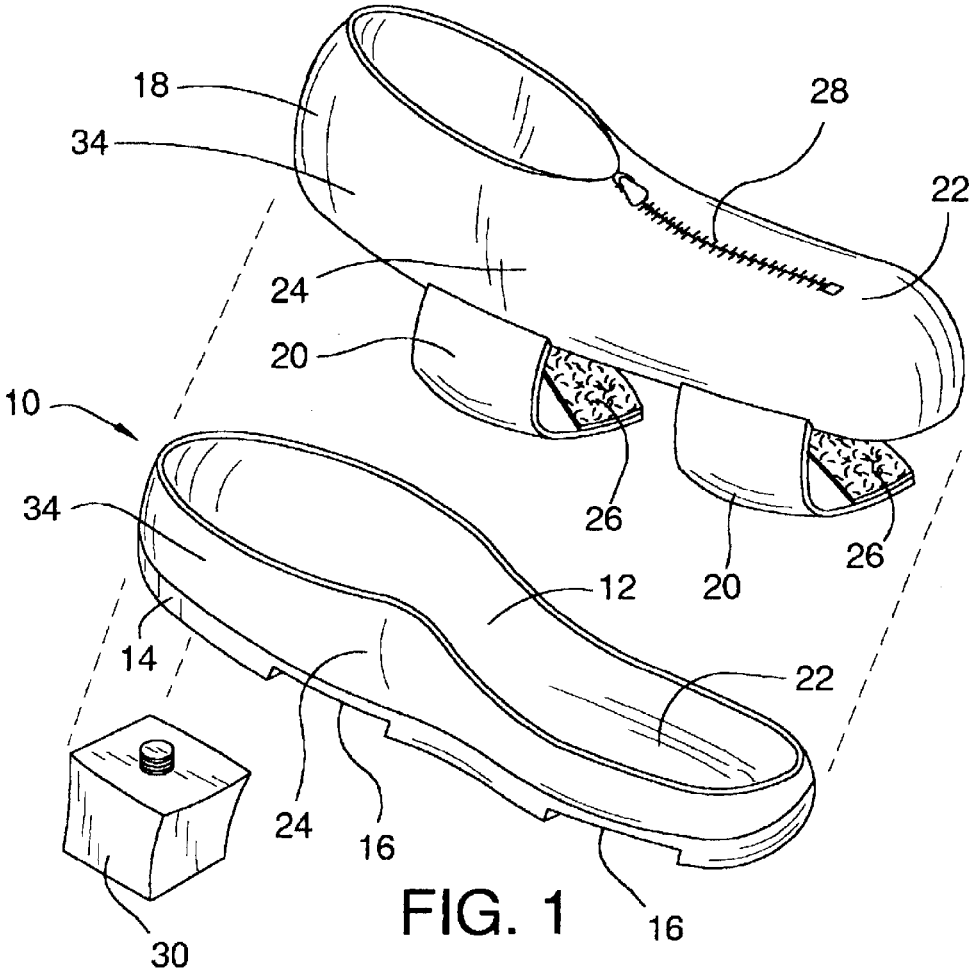
FIG. 1 is a side perspective view of the separated parts of the preferred embodiment of the shoe with interchangeable covers constructed in accordance with the principles of the present invention.

Referring now to the drawings, and particularly to FIGS. 1–6, a preferred embodiment of the shoe with interchangeable covers of the present invention is shown and generally designated by the reference numeral 10.

In FIG. 1, a new and improved shoe with interchangeable covers 10 of the present invention for easily and comfortably updating a single pair of shoes to coordinate with multiple outfits is illustrated and will be described. More particularly, the shoe with interchangeable covers 10 has a base 12 mounted on a modified shoe sole 14. The base 12 would be constructed of leather, while the sole 14 could be made similar to standard soles with the inclusion of a pair of notches 16 on the bottom. The base 14 would rise up slightly on each side and would be covered on the sides by an interchangeable cover 18. This interchangeable cover 18 would be secured to the base 14 by two pairs of straps 20 pulled around the notches 16 and connected beneath the sole 14. One pair of straps 20 would be located toward the toe area 22 of the cover 18, with a strap 20 on each side of the cover 18, and the other pair of straps 20 would be located in the arch area 24 of the cover 18. Each set of straps 20 would be affixed to the sole by pulling the strap from each side of the cover 18 around and under the sole 14, where they would be attached with hook and loop type fasteners 26, such as Velcro®. This particular cover 18 features a zipper 28 running down the front of the cover 18 to the toe area 22. A removable and interchangeable heel 30 can also be screwed onto the bottom of the sole 14. The heel 30 could be produced in various heights and widths.

Figure 2:
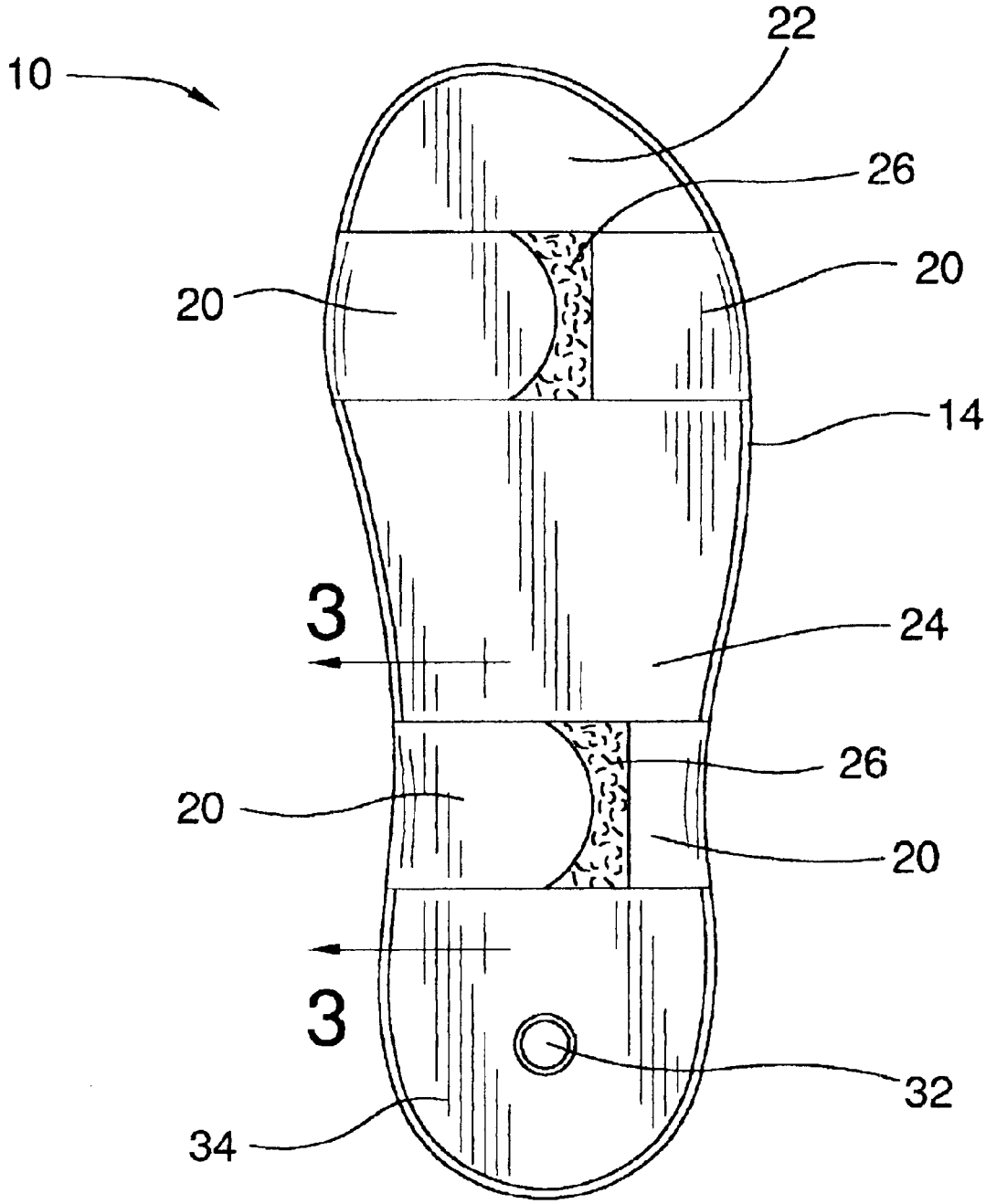
FIG. 2 is a bottom view of the shoe with interchangeable covers of the present invention.

FIG. 2 shows a bottom view of the shoe with interchangeable covers 10. This view shows the threaded aperture 32 centered in the heel area 34 of the sole 14 into which the removable heel 30 would be inserted. The shoe 10 could, of course, be worn with no heel 30, if desired. The pairs of straps 20 can be seen to be connected along the notches 16 on the bottom of the sole 14. The strap 20 from each side of the cover 18 would reach slightly more than half the width of the sole 14 to attach to the corresponding strap 20 from the other side of the cover 18.

Figure 3:
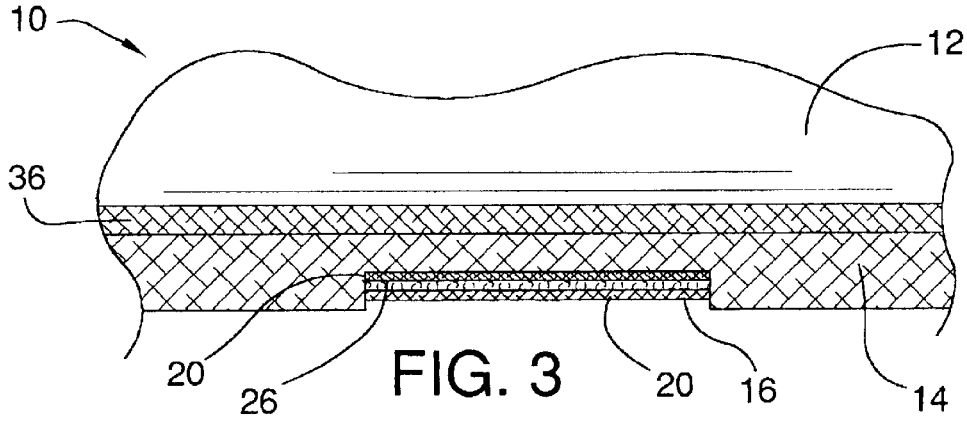
FIG. 3 is a side sectional view of the shoe with interchangeable covers of the present invention.

FIG. 3 shows a side sectional view of the shoe with interchangeable covers 10. This view details the layer of padding 36 that exists between the base 12 and the sole 14 of the shoe 10. This padding 36 would be similar to standard padding that is inserted into shoes for added comfort and would cover the top surface of the sole 14. The base 12 would enclose the padding 36 so that it was not externally visible. The notch 16 in the arch area 24 of the sole 14 is also portrayed in greater detail. In can be seen that the pair of straps 20 will overlap when properly secured, with one portion of the fastener 26 on the internal side the first strap 20 and the other portion of the fastener 26 on the external side of the second strap 20.

Figure 4:
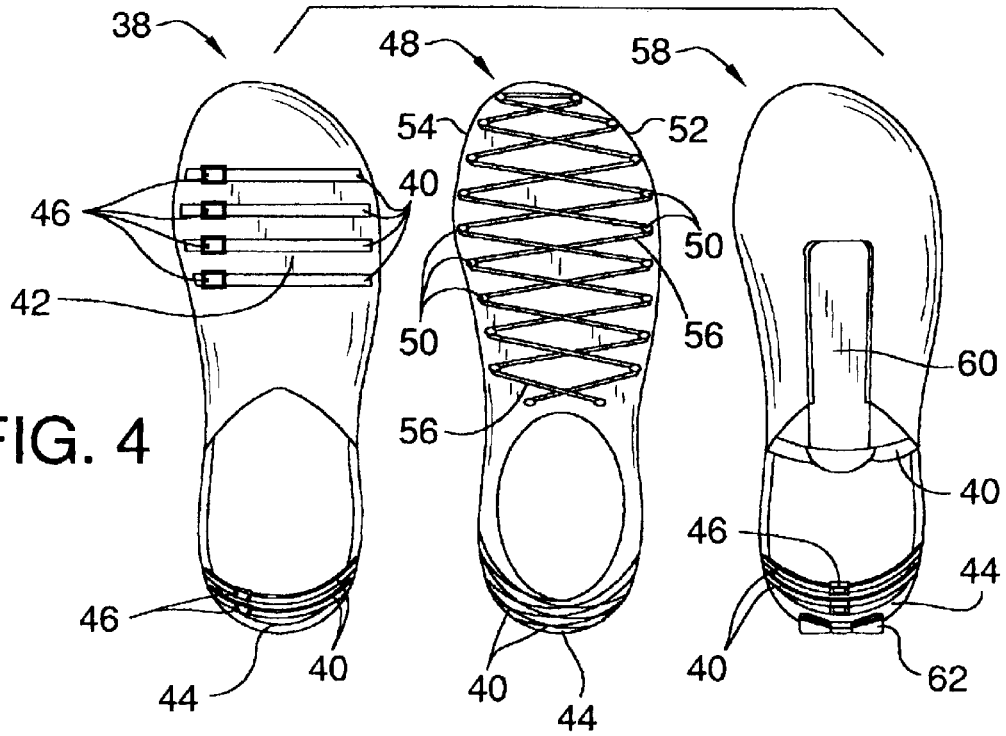
FIG. 4 is a top view of various covers for the shoe with interchangeable covers of the present invention.
Figure 5:
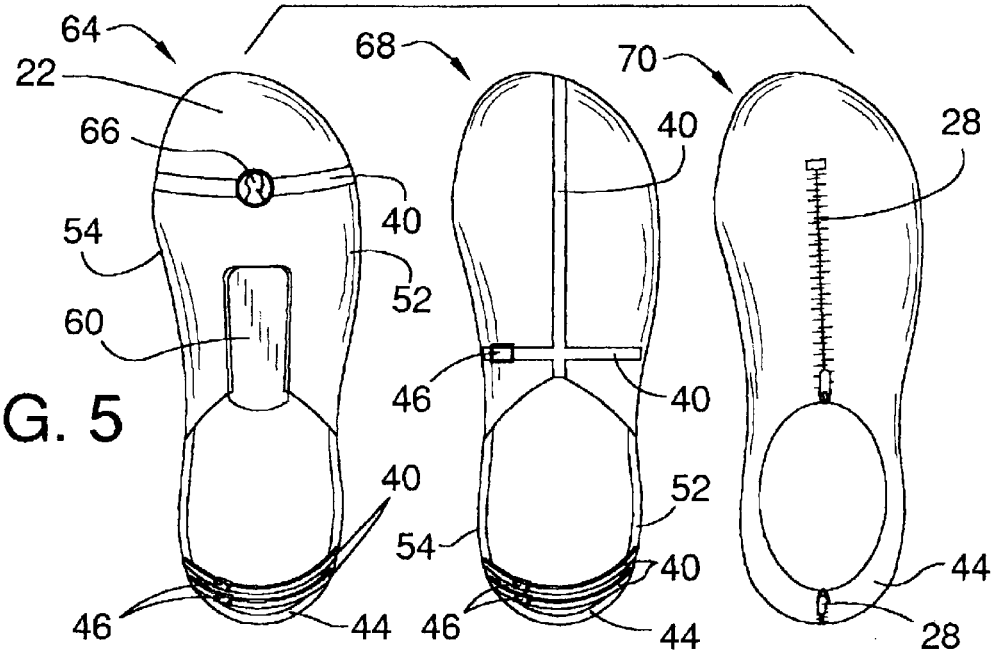
FIG. 5 is a top view of various covers for the shoe with interchangeable covers of the present invention.
Figure 6:
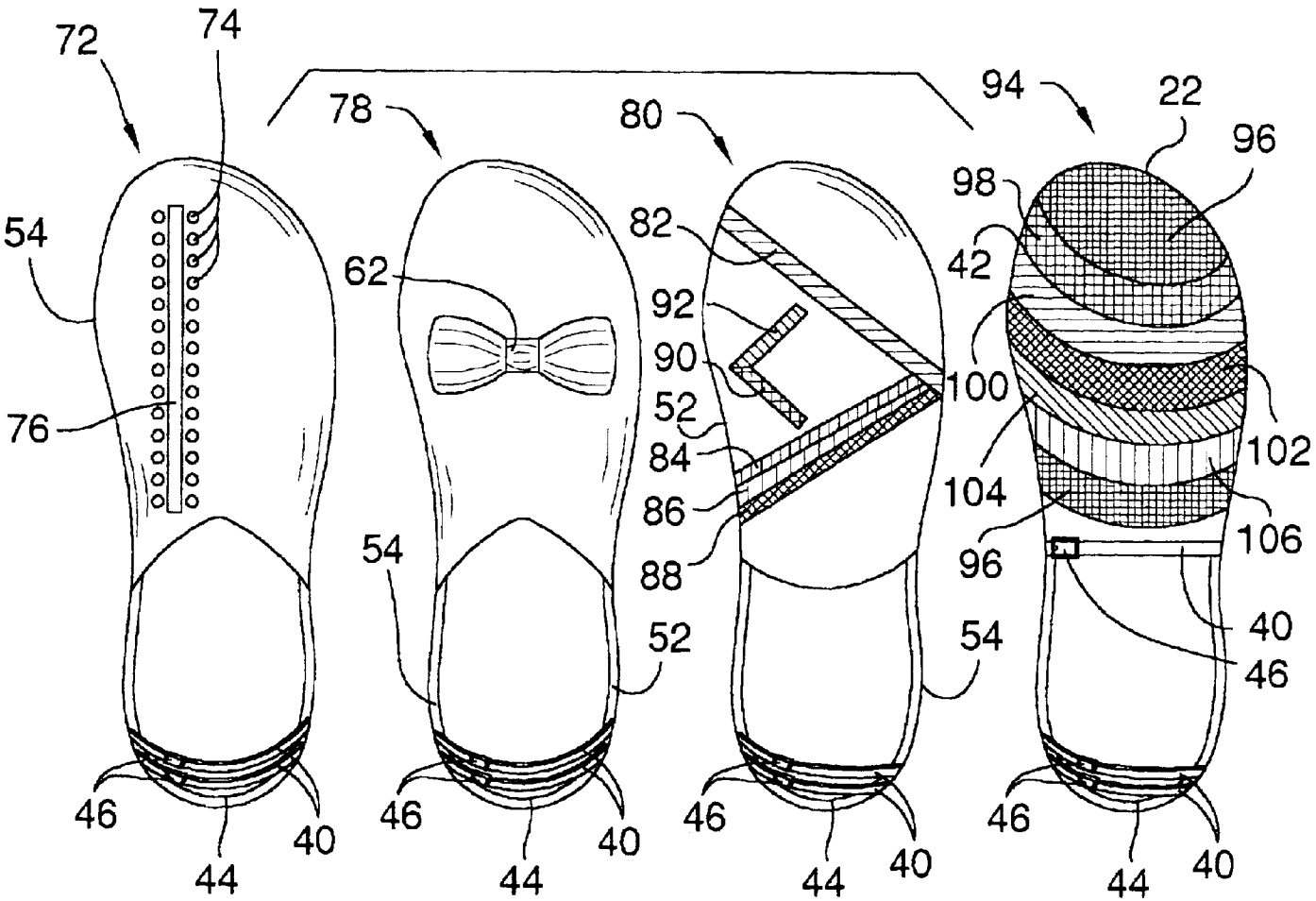
FIG. 6 is a top view of various covers for the shoe with interchangeable covers of the present invention.

FIGS. 4, 5, and 6 show a total of ten designs for the interchangeable cover 18 for the shoe 10. The first cover 38 is a clog style shoe with an open back and features a plurality of decorative straps 40 across the top front portion 42 and around the open heel area 44 of the cover 18. Each of the decorative straps 40 would be adorned with a metal buckle 46. The second cover 48 is a closed heel shoe with a plurality of hooks 50 located in pairs on the right and left edges, 52 and 54, of the front portion 42 of the shoe, with one hook 50 from each pair on the right edge 52 and one hook 50 from each pair on the left edge 54. The middle of a cord 56 is wrapped around the foremost pair of hooks 50 and the ends are then crossed before wrapping them around the next adjacent pair of hooks 50. This pattern continues until the cord 56 is wrapped around each pair of hooks 50. The heel area 44 of the shoe is formed with a lacy design of braided decorative straps 40. The third cover 58 is another clog style shoe with an open back and features a tongue 60 at the top center of the cover 18. The tongue 60 extends rearward beyond the main portion of the cover 18, which has a concave curvature, and is joined to the side of the cover 18 by a thin decorative strap 40. A plurality of decorative straps 40 adorned with buckles 46 curves around the open heel area 44, and a bow 62 is attached toward the bottom of the heel area 44. The fourth cover 64 is a clog style shoe with an open back and features a single decorative strap 40 across the top of the toe area 22 of the shoe. Attached to the center of the strap 40 is a penny 66. The heel area 44 of the shoe is formed with a plurality of decorative straps 40 adorned with buckles 46 curving from the right edge 52 to the left edge 54 of the cover 18. In addition, the tongue 60 feature mentioned in the third cover 58 is also present in this model; however, there is no slender strap 40 connecting it to the sides of the cover 18. The fifth cover 68 is a clog style shoe with an open back and features a decorative strap 40 running along the top center of the shoe crossed by a second strap 40 running perpendicular to the first strap 40 and across the width of the shoe. The heel area 44 of the shoe is once again formed with a plurality of decorative straps 40 adorned with buckles 46 curving from the right edge 52 to the left edge 54 of the cover 18. The sixth cover 70 is a closed back shoe featuring a zipper 28 running along the top center of the cover 18 and a second zipper 28 running down the length of the back center. The seventh cover 72 is an open back clog with a plurality of buttons 74 running down the front on a line slightly off center toward the left edge 54. The buttons 74 are arranged in pairs with a decorative strip 76 between them. A plurality of decorative straps 40 adorned with buckles 46 forms the heel area 44 of the cover 18. The eighth cover 78 is an open back clog featuring a large bow 62 attached on the top center of the cover 18. Once again the heel area 44 is formed with decorative straps 40 adorned with buckles 46 curving from the right edge 52 to the left edge 54 of the cover 18. The ninth cover 80 is an open back clog style shoe with a plurality of colored strips 76 placed in V-shapes on the top of the cover 18. The foremost of these is a blue strip 82 which joins with a band made of a red, pink, and orange strip, 84, 86, and 88, to form a large V with the point on the right edge 52 of the cover 18. A smaller v, pointed in the opposite direction, is formed from a yellow strip 90 joined to a green strip 92. The heel area 44 is defined by buckle 46 adorned straps 40 curving from the right edge 52 to the left edge 54 of the cover 18. The tenth cover 94 is an open back style with a plurality of curved patches joined together to form the front portion 42 of the cover 18. The front toe area 22 is covered by a black patch 96, which is followed by a yellow patch 98, a blue patch 100, an orange patch 102, a green patch 104, a pink patch 106, and a second black patch 94. A single decorative strap 40 with a metal buckle 46 passes over the top of the wearer's foot. The heel area 44 of the cover 18 is formed of straps 40 adorned with rainbow buckles 46.

The concept of the shoe with interchangeable covers is a modified pair of women's shoes with the major modification involving the versatility of the shoe to convert to various styles by interchanging different types and colors of coverings for the shoe body. This feature would enable the individual to have numerous pairs of shoes for the price of one. While the shoe with interchangeable covers could be worn by various women, it might be of particular appeal to working women as well as female travelers.

The shoe with interchangeable covers would consist of a leather shoe containing a heel which could be produced in various heights and widths. Accompanying the shoe would be various coverings which could transform the appearance of the foot covering. A wide range of designs and colors would be available and would help make this product fashionable and trendy. The various coverings would be held in place by straps containing hook and loop style fasteners which would rest beneath the sole of the shoe. The wearer could easily and quickly change shoe styles by disengaging the hook and loop fasteners, removing the cover, and replacing it with another cover that is secured by fastening the straps together.

The ability to quickly and easily alter the style of the shoe would make the foot coverings more versatile as they could coordinate with a multitude of ensembles. The consumer would save money by getting more out of one pair of shoes. The multiple designs for various covers run the gamut from casual and sporty to dressy and elegant. Furthermore, this foot covering would save valuable space within a suitcase while traveling. Its design could eliminate the need to transport a separate suitcase solely for transporting numerous pairs of shoes.

While a preferred embodiment of the shoe with interchangeable covers has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable material such as leather, suede, canvas, or other typical shoe materials can be used to make the shoe cover. Also, the sole and base of the shoe can be made of leather, rubber, wood, or other suitable materials. Furthermore, a wide variety of adornments, such as rhinestones, ribbons, and feathers to name a few, could be added to the shoe covers beyond the decorative items discussed above.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoe with interchangeable covers comprising:

a base having a horizontal portion with a top surface, a bottom surface and an outer edge with a right edge and a left edge and formed in the shape of conventional shoe base with a toe area at the front, an arch area in the middle, and a heel area at the back, and a vertical portion affixed to said outer edge of said horizontal portion wherein said vertical portion is extended perpendicularly upward from said horizontal portion;

a sole formed with the same shape as said horizontal portion of said base and having a toe area at the front, an arch area in the middle, a heel area at the back, a right edge, a left edge, a top surface, and a bottom surface formed with a notch in said toe area and a notch in said arch area wherein each said notch runs from said right edge to said left edge and connected on said top surface to said bottom surface of said base wherein said horizontal portion of said base covers the entirety of said top surface of said sole;

a removable cover having a toe area at the front, an arch area in the middle, and a heel area at the back and formed with a right side having a bottom and a top and formed wherein said bottom is approximately vertical and slopes inward and said top is approximately horizontal and a left side having a bottom and a top and formed similarly and symmetrical to said right side wherein said top of said left side joins with said top of said right side leaving an opening at said heel area of said cover, and removably connected at said bottom of said right and said left sides to said vertical portion of said base wherein said vertical portion of said base is covered by said right and said left sides;

a first pair of flexible straps having a right strap and a left strap, each having a first end and a second end and a width approximately equal to the width of said notch in said toe area of said sole and a length slightly less than the length of said notch in said toe area of said sole, and connected to said toe area of said cover wherein said first end of said right strap is connected to said bottom of said right side of said cover, said first end of said left strap is connected to said bottom of said left side of said cover, and said second end of said right strap is capable of overlapping said second end of said left strap when said straps are positioned in said notch in said toe area of said sole;

a first fastener having a first portion and a second portion and connected to said first pair of flexible straps wherein said first portion is connected to said second end of said right strap and said second portion is connected to said second end of said left strap;

a second pair of flexible straps having a right strap and a left strap, each having a first end and a second end and a width approximately equal to the width of said notch in said arch area of said sole and a length slightly less than the length of said notch in said arch area of said sole, and connected to said arch area of said cover wherein said first end of said right strap is connected to said bottom of said right side of said cover, said first end of said left strap is connected to said bottom of said left side of said cover, and said second end of said right strap is capable of overlapping said second end of said left strap when said straps are positioned in said notch in said arch area of said sole; and a second fastener having a first portion and a second portion and connected to said second pair of flexible straps wherein said first portion is connected to said second end of said right strap and said second portion is connected to said second end of said left strap.

2. The shoe with interchangeable covers of claim 1 wherein said base further comprises:

a layer of padding having approximately the same shape as said horizontal portion of said base and connected to said top surface of said horizontal portion of said base wherein said padding is contained within said outer edge of said horizontal portion of said base by said vertical portion of said base.

3. The shoe with interchangeable covers of claim 2 wherein said base is made of leather.

4. The shoe with interchangeable covers of claim 1 wherein said first fastener is a hook and loop type fastener.

5. The shoe with interchangeable covers of claim 1 wherein said second fastener is a hook and loop type fastener.

6. The shoe with interchangeable covers of claim 1 wherein said bottom surface of said heel area of said sole is formed with a threaded transverse aperture and further comprises:

a removable heel having a top formed with a transverse aperture and a bottom; and a threaded screw connected to said top of said heel wherein said screw is securely inserted into said aperture in said top of said heel, leaving a part of said screw above said top of said heel for insertion into said threaded transverse aperture in said sole.

7. The shoe with interchangeable covers of claim 1 wherein said cover further comprises:

a zipper joining said top of said left side of said cover with said top of said right side of said cover.

8. The shoe with interchangeable covers of claim 7 wherein said cover further comprises:

a zipper joining said left side of said cover with said right side of said cover at said heel area of said cover.

9. The shoe with interchangeable covers of claim 1 wherein said cover further comprises a plurality of decorative items connected to said right or said left side of said cover.

10. The shoe with interchangeable covers of claim 9 wherein said decorative items are selected from the set comprising:

a. zippers;

b. straps;

c. buckles;

d. cords;

e. hooks;

f. lace;

g. a tongue;

h. bows;

i. multicolored strips of material;

j. a penny;

k. buttons;

l. rhinestones; and m. ribbons.

11. A shoe with interchangeable covers comprising:

a base having a horizontal portion with a top surface, a bottom surface and an outer edge with a right edge and a left edge and formed in the shape of conventional shoe base with a toe area at the front, an arch area in the middle, and a heel area at the back, and a vertical portion affixed to said outer edge of said horizontal portion wherein said vertical portion is extended perpendicularly upward from said horizontal portion;

a layer of padding having approximately the same shape as said horizontal portion of said base and connected to said top surface of said horizontal portion of said base wherein said padding is contained within said outer edge of said horizontal portion of said base by said vertical portion of said base;

a sole formed with the same shape as said horizontal portion of said base and having a toe area at the front, an arch area in the middle, a heel area at the back, a right edge, a left edge, a top surface, and a bottom surface formed with a threaded transverse aperture in said heel area, a notch in said toe area, and a notch in said arch area wherein each said notch runs from said right edge to said left edge and connected on said top surface to said bottom surface of said base wherein said horizontal portion of said base covers the entirety of said top surface of said sole;

a heel having a top formed with a transverse aperture into which a portion of a threaded screw is securely inserted and a bottom and removably connected at said top to said heel area of said bottom surface of said sole wherein said threaded screw is inserted into said threaded transverse aperture in said heel area of said bottom surface of said sole;

a removable cover having a toe area at the front, an arch area in the middle, and a heel area at the back and formed with a right side having a bottom and a top and formed wherein said bottom is approximately vertical and slopes inward and said top is approximately horizontal and a left side having a bottom and a top and formed similarly and symmetrical to said right side wherein said top of said left side joins with said top of said right side leaving an opening at said heel area of said cover, and removably connected at said bottom of said right and said left sides to said vertical portion of said base wherein said vertical portion of said base is covered by said right and said left sides;

a first pair of flexible straps having a right strap and a left strap, each having a first end and a second end and a width approximately equal to the width of said notch in said toe area of said sole and a length slightly less than the length of said notch in said toe area of said sole, and connected to said toe area of said cover wherein said first end of said right strap is connected to said bottom of said right side of said cover, said first end of said left strap is connected to said bottom of said left side of said cover, and said second end of said right strap is capable of overlapping said second end of said left strap when said straps are positioned in said notch in said toe area of said sole;

a first fastener having a first portion and a second portion and connected to said first pair of flexible straps wherein said first portion is connected to said second end of said right strap and said second portion is connected to said second end of said left strap;

a second pair of flexible straps having a right strap and a left strap, each having a first end and a second end and a width approximately equal to the width of said notch in said arch area of said sole and a length slightly less than the length of said notch in said arch area of said sole, and connected to said arch area of said cover wherein said first end of said right strap is connected to said bottom of said right side of said cover, said first end of said left strap is connected to said bottom of said left side of said cover, and said second end of said right strap is capable of overlapping said second end of said left strap when said straps are positioned in said notch in said arch area of said sole; and a second fastener having a first portion and a second portion and connected to said second pair of flexible straps wherein said first portion is connected to said second end of said right strap and said second portion is connected to said second end of said left strap.

12. The shoe with interchangeable covers of claim 11 wherein said base is made of leather.

13. The shoe with interchangeable covers of claim 11 wherein said first fastener is a hook and loop type fastener.

14. The shoe with interchangeable covers of claim 11 wherein said second fastener is a hook and loop type fastener.

15. The shoe with interchangeable covers of claim 11 wherein said cover further comprises:

a zipper joining said top of said left side of said cover with said top of said right side of said cover.

16. The shoe with interchangeable covers of claim 15 wherein said cover further comprises:

a zipper joining said left side of said cover with said right side of said cover at said heel area of said cover.

17. The shoe with interchangeable covers of claim 11 wherein said cover further comprises a plurality of decorative items connected to said right or said left side of said cover.

18. The shoe with interchangeable covers of claim 17 wherein said decorative items are selected from the set comprising:

a. zippers;

b. straps;

c. buckles;

d. cords;

e. hooks;

f. lace;

g. a tongue;

h. bows;

i. multicolored strips of material;

j. a penny;

k. buttons;

l. rhinestones; and m. ribbons.

* * * * *